US005515901A

United States Patent [19]

Hall

[11] Patent Number: 5,515,901

[45] Date of Patent: May 14, 1996

[54] FASCIA FOR BIFOLD DOORS

[75] Inventor: W. James Hall, Weston, Canada

[73] Assignee: DSH Inc., Concord, Canada

[21] Appl. No.: 483,910

[22] Filed: Jun. 7, 1995

Related U.S. Application Data

[63] Continuation of Ser. No. 294,037, Aug. 24, 1994, abandoned, which is a continuation of Ser. No. 12,951, Feb. 3, 1993, abandoned, which is a continuation-in-part of Ser. No. 829,286, Feb. 3, 1992, abandoned.

[51] Int. Cl.[6] ..... E05D 15/26

[52] U.S. Cl. ..... 160/206; 160/38

[58] Field of Search ..... 160/19, 38, 39, 160/199, 206, 196.1, 113

[56] References Cited

U.S. PATENT DOCUMENTS

| | | | |
|---|---|---|---|
| 2,277,240 | 3/1942 | Lowry | 160/38 |
| 2,577,884 | 12/1951 | Garubo | 160/206 X |
| 2,653,656 | 9/1953 | Kuebler | 160/19 |
| 3,124,195 | 3/1964 | Anderson | 160/19 |
| 3,469,619 | 9/1969 | Barnett | 160/19 |
| 3,983,600 | 10/1976 | Smith | 160/38 X |
| 4,014,072 | 3/1977 | Schumacher . | |
| 4,222,427 | 9/1980 | Buchner . | |

*Primary Examiner*—David M. Purol
*Attorney, Agent, or Firm*—Ridout & Maybee

[57] ABSTRACT

A fascia assembly for folding doors particularly for bifold doors, uses an elongated fascia element spanning the doorway in which the doors are installed, the element being freely suspended by a hinge from a support mounted to the top of the doorway adjacent a track, which guides the door during its folding movement, for swinging movement about an axis parallel to the track so that it may pass above the tops of the doors. The fascia element has sufficient vertical extent to span from the top of the doorway to and beyond the tops of the doors, and is mounted to that side of the doors facing the direction in which they open. As the doors open, the fascia element can swing upwards out of the way of the doors. Conveniently, both the fascia element and the support are elongated elements of constant cross-section and the hinge is formed by interlocking edge portions of these two elements.

8 Claims, 5 Drawing Sheets

22
26
36
34
24
46
38
32
18

FASCIA FOR BIFOLD DOORS

REFERENCE TO RELATED APPLICATION

This application is a continuation of application Ser. No. 08/294,037filed Aug. 24, 1994, now abandoned, which is a continuation of application Ser. No. 08/012,951, filed Feb. 3, 1993, now abandoned, which is a continuation-in-part of application Ser. No. 07/829,286 filed Feb. 3, 1992, now abandoned.

BACKGROUND OF THE INVENTION

1. Field of the Invention

This invention relates to a fascia structure for folding doors, particularly for bifold doors, and to a bifold door assembly or hardware kit including such a fascia.

2. Review of the Art

Unlike conventional side hinged single panel doors, bifold doors have two door panels hinged to each other at adjacent vertical edges, the other vertical edges of the panels being respectively supported by pivot members adjacent a jamb of a doorway and guided by a track for movement across the doorway. To open bifold doors, one pushes or pulls the two hinged door panels. The two panels can be arranged to fold in either direction, but closet doors normally fold outwards for space reasons. Doorways in which bifold doors are mounted are rarely completely rectangular because of construction problems. Although the position of the doors can be adjusted by means of screws or other adjustments associated with the pivot brackets, it is frequently impossible to align the doors in the opening without leaving an unsightly tapering gap at either the top or sides of the door. With other types of door, this problem can be overcome by the use of a trim unit or valance, fitted to the door frame to screen the unsightly gap that frequently occurs particularly between the top of a door and its frame. Such units are exemplified in U.S. Pat. No. 4,014,072, issued Mar. 29, 1977 to William J. Schumacher et al, and U.S. Pat. No. 4,222,427, issued Sep. 16, 1980 to John Buchner. However, such a trim unit cannot be mounted to a door frame in the path of the folding motion of bifold doors since it would interfere with the folding action of the door, which is projected outwardly from the plane of door when in a closed position by a considerable distance, comparable to the width of a door panel.

U.S. Pat. No. 2,577,884 (Garubo) discloses an L-shaped, hinged valance for a multipanel folding door in which the vertical stem of the L-shape provides a valance when the door is closed, and the valance hinges outwardly so that the initially horizontal stem of the L-shape provides a valance as the panels turn about their vertical axes. Such an arrangement can only accommodate a very limited projection of the door panels and cannot thus be used with a bifold door.

An object of this invention is to provide a fascia structure for bifold doors, which will not interfere with folding motion of the doors.

SUMMARY OF THE INVENTION

In accordance with the invention a fascia assembly for bifold doors, or a bifold door assembly or hardware kit, uses an elongated fascia element spanning the doorway in which the doors are installed, the element being freely suspended by a hinge from support means mounted to the top of the doorway, adjacent a track which guides the door during its folding movement, for swinging movement about an axis parallel to the track. The fascia element has a vertical extent less than the forward projection of the doors, and is slim enough and has a rear surface smoothly profiled so that it may pass above the tops of the doors. The fascia element has sufficient vertical extent to span from the top of the doorway to and beyond the tops of the doors, and is mounted to that side of the doors facing the direction in which they open. As the doors open, the fascia element can swing upwards out of the way of the doors. Conveniently, both the fascia element and the support means are elongated elements of constant cross-section, and the hinge is formed by interlocking edge portions of these two elements. The fascia element and support means may be formed with cooperating latching detents such that the fascia element may be latched in a raised position during installation or adjustment of the doors.

Further features of the invention will be apparent from the following description with reference to the accompanying drawings, illustrating by way of example one embodiment thereof.

DESCRIPTION OF THE PREFERRED EMBODIMENT

Figure 1:
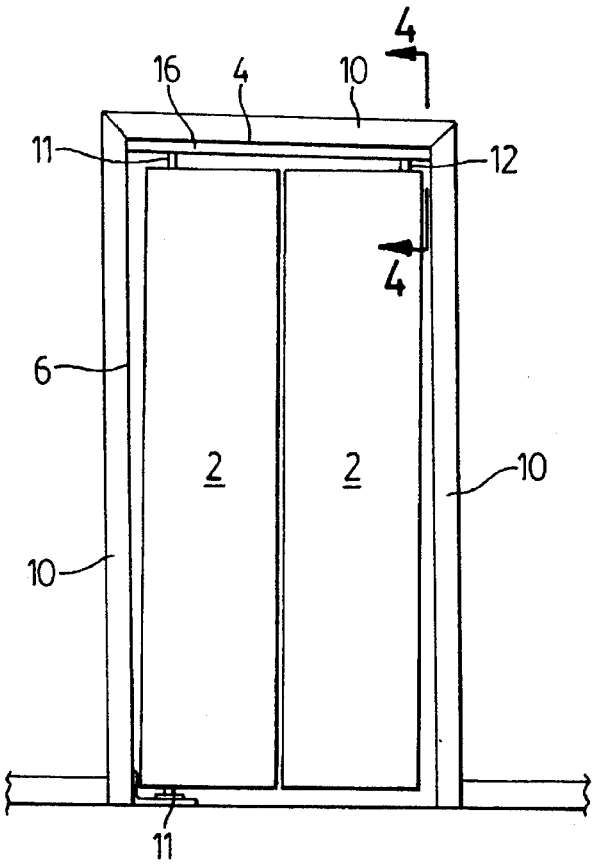
FIG. 1 (PRIOR ART)
FIG. 1 is a frontal view of a prior art bifold door installation.
Figure 3:
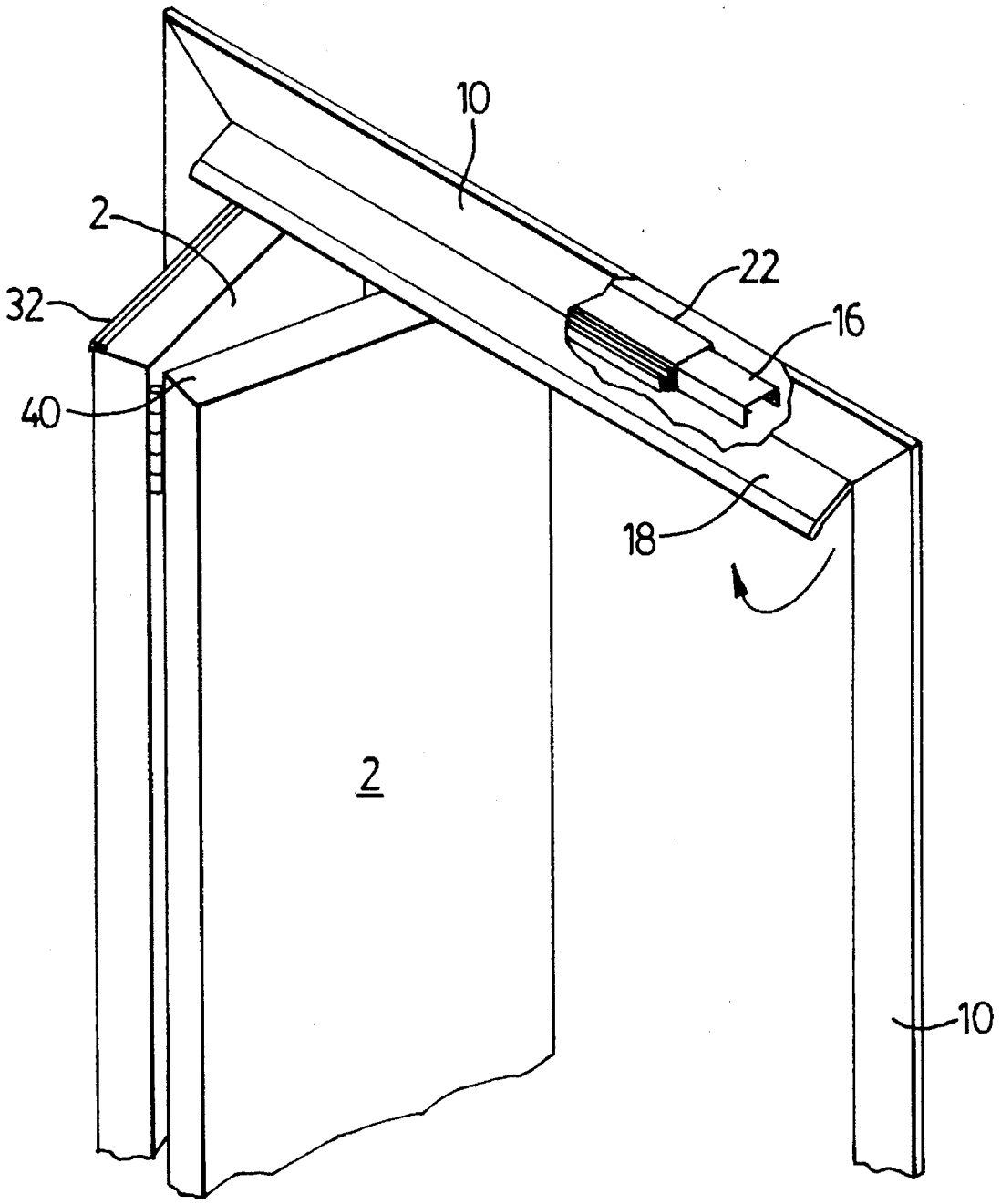
FIG. 3 is a fragmentary perspective view of the bifold door installation of FIG. 2, in an open condition.
Figure 4:
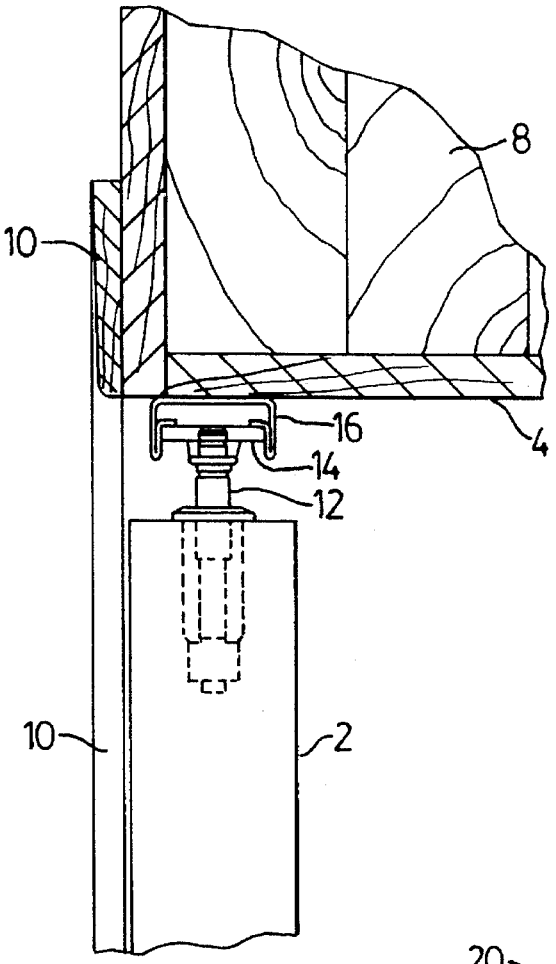
FIG. 4 (PRIOR ART)
FIGS. 4 and 5 are fragmentary cross-sections on the lines 4—4 of FIG. 1 and 5—5 of FIG. 2 respectively.

Referring to FIGS. 1 and 4, the environment in which the present invention is utilized is a bifold door installation, comprising one or more pairs of bifold doors 2 installed in a doorway having a head 4 a threshold and jambs 6 defining the top bottom and sides of the doorway, the mounting of the head and jambs to the lintel 8 and other framing members of the doors being concealed in conventional manner by trim 10. One of each pair of bifold doors is conventionally supported adjacent one edge by adjustable top and bottom pivot members 11, the door being hinged at its edge to the second door of the pair. The free edge of the second door is guided by means of a guide pin 12, which may carry a roller 14, the guide pin being spring biased to project from a socket received in a top rail of the door at a location adjacent its free edge, and engaging a track 16 mounted beneath the head 4 at the top of the doorway. As seen in FIG. 3, the hinged edges of the doors 2 will be projected outwardly as the doors open.

Whilst the pivot members supporting the doors can be adjusted to bring the vertical edges of the doors 2 parallel to the jambs 6 (see FIG. 2), construction tolerances usually result in doorways not being fully rectangular, which means that the top edges of the doors will not be accurately parallel with the head 4 of the doorway. Hitherto, it has not been possible to hide the resulting unsightly and uneven gap, although best results are usually achieved by adjusting the doors so that their top edges are parallel to the head 4, at the expense of parallelism between the side edges of the doors and the jambs.

In the case of sliding doors, a fascia element can be utilized, which can if necessary be made adjustable as described in the above mentioned Buchner patent, but this solution is less satisfactory for bifold doors since the outward projection of the doors as they open means that the fascia element must have its lower edge high enough not to be fouled by the doors as they open, and set accurately parallel to the upper edges of the doors when closed.

Figure 5:
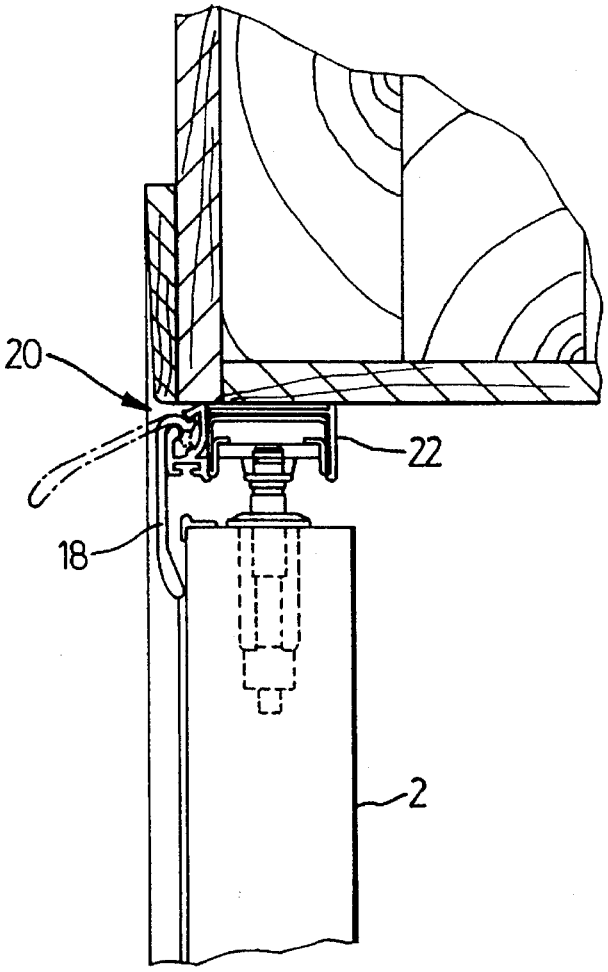
Figure 6:
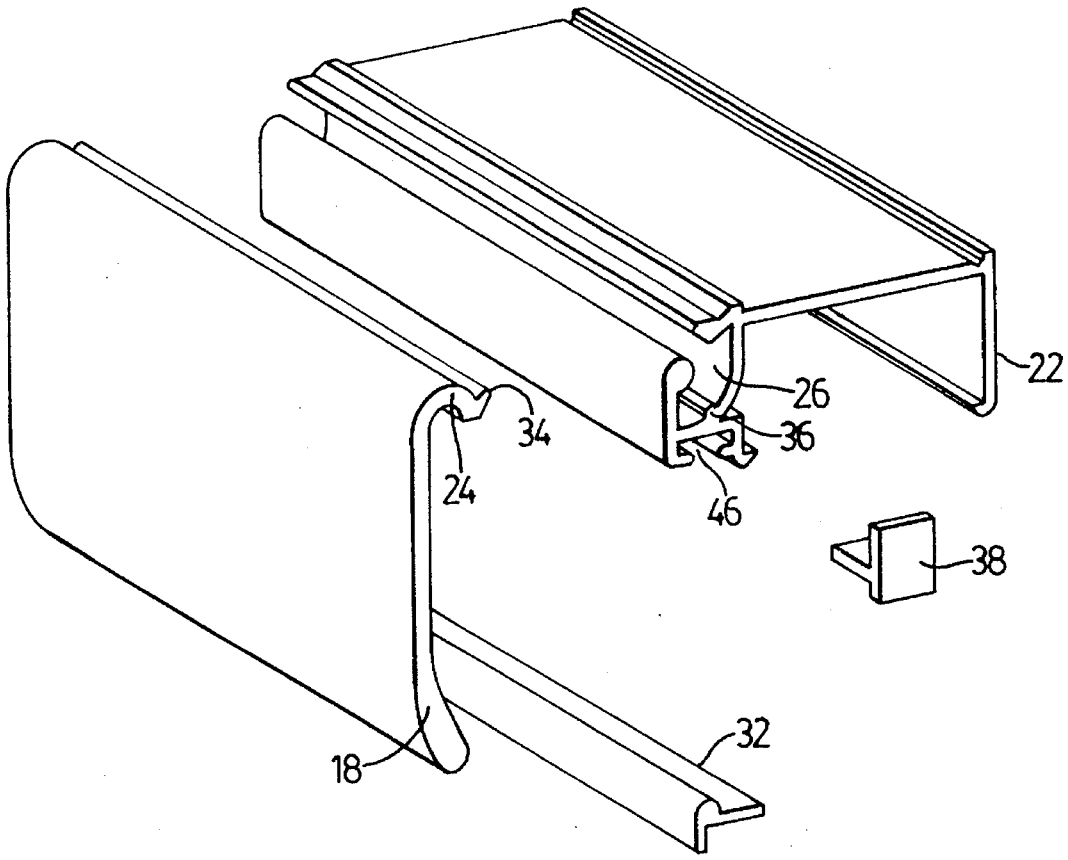
FIG. 6 is an isometric fragmentary exploded view of components used in the embodiment of FIG. 2.

Referring to the remaining Figures, I overcome this problem by providing an elongated fascia element 18 spanning the width of the doorway, which is freely suspended by a hinge 20 from a support member 22, in this case an element extending longitudinally so as to surround the external surface of the track and be clamped between the track 16 and the head 4 of the doorway. Typically, and as best seen in FIGS. 5 and 6, a laterally offset arm 24 formed as a continuation of a top edge of the fascia element 18 enters a socket 26 defined in a portion of the support member 22 so as to form together the hinge 20. The fascia element and support member 22 are conveniently plastic or metal extrusions or roll formed profiles of constant cross-section, the materials chosen having sufficient flexibility, and the interengagement of the arm 24 and socket 26 being sufficiently loose, that the fascia element will be freely suspended for swinging motion and can move under the influence of gravity, even if the head 4 of the door is not completely straight or the alignment of the parts is slightly imperfect. The offset of the arm 24 towards the door relative to the general plane of the element 18 means that gravity acts to bias the latter against the door in its closed position, the vertical extent of the element being such that it extends to the top of the door opening and also overlaps top portions of the doors sufficiently to allow for any reasonably anticipated tolerance in door and doorway dimensions. In other words, the depth of the fascia element beneath the hinge must be sufficient to exceed the maximum combined vertical extent permitted by the track 16 and the associated pivot and pin 11 and 12 between the hinge and the top of the door, and its cross-sectional profile must be sufficiently narrow to allow it to swing upwardly, sufficiently to clear the top edges of the doors in an installation having a minimum combined vertical extent between the hinge and the doors permitted by the track, pivot and pin. The fascia must also be free of projections on its rear surface capable of obstructing outward movement of the doors, and has a depth which is much less than the outward projection of the doors as they open.

As the doors are opened (see FIG. 3), the hinged edges of the doors 2 are projected outwardly, and impinge upon and swing the fascia element 18 upwardly out of the path of the door until it can slide over the top surfaces 40 of the doors as best seen in FIG. 3. As the doors begin to close, the fascia element slides back over the top surfaces and eventually drops down to its original position under the influence of gravity as the doors reach a closed position, with a neat appearance being maintained at all times. A small biasing spring could be used to supplement the action of gravity if necessary. The rear surface of the element 18 is smoothly profiled as shown so that its moves readily without snagging over the top edges of the doors, which may be fitted with corner trims 32 to assist sliding action of the element 18.

Further benefits of the invention are that the appearance of the guide track becomes unimportant, which may permit the use of an unfinished component and/or the elimination of separate trim used to hide the track, as well as any painting of such trim which might be required. Conveniently however, the support member 22 encloses all but the lower surface of the track 16 or could be integral with it. The doors may be aligned accurately parallel to the jambs (see FIG. 2) without any compromises being necessary to preserve reasonable alignment with the top of the door opening, since any lack of alignment at the top of the doors will be invisible.

A longitudinal detent projection 34 is formed on the arm 24, which enters detenting engagement with a further detent projection 36 formed within the socket 26 as the fascia 18 is raised to a horizontal position, thus enabling the latter to be temporarily supported out of the way during installation or adjustment of the doors 2. End caps 38 inserted into recesses 46 in the support member 22 restrain the fascia element 18 against longitudinal movement into contact with the jambs 6. The projection 34 also prevents accidental disengagement of the arm from the socket.

Figure 7:
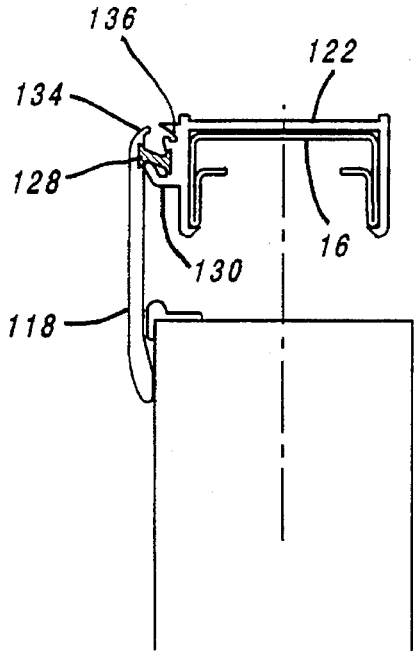
FIGS. 7–10 are end views of components utilized in modified embodiments of fascia assembly.

Various modifications are possible within the scope of the invention as set forth in the appended claims. The fascia element and support member may have different sections, the support element need not be continuous, and different hinging mechanisms could be used. Four examples are shown in FIGS. 7 to 10. Referring to FIG. 7, the support member 122 is formed as a channel section which clips over the track 16. It is co-extruded with the fascia element 118, the two being connected by a flexible coextruded hinge member 128 of flexible polyvinyl chloride or other suitably flexible material. A protruding lip 130 supports the hinge member 128 adjacent the fascia member so as to maintain the vertical position of the latter when doors are closed. A corner trim 32 may as in the previous embodiment be applied to the top front edges of the doors 2 to ensure smooth engagement with the fascia during opening of the doors.

A detenting bead 134 formed along the upper edge of the fascia element 118 enters detenting engagement with a reentrant detenting groove 136 in the member 122 when the fascia element is raised to a horizontal position, thus again enabling the latter to be supported temporarily out of the way during door installation or adjustment.

Figure 8:
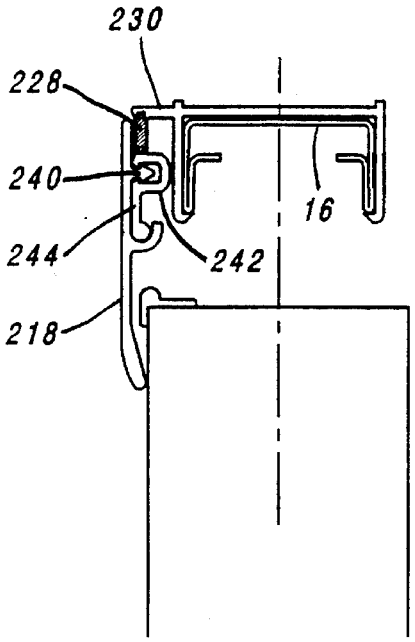

A somewhat similar embodiment is shown in FIG. 8, except that the lip 230 acts as a suspension member for a coextruded hinge member 228 and a coextruded support member 244 to which a separately formed fascia element 218 may be releasably secured by means of a retainer element 240 entering a socket 242 during installation or adjustment of the doors.

Figure 2:
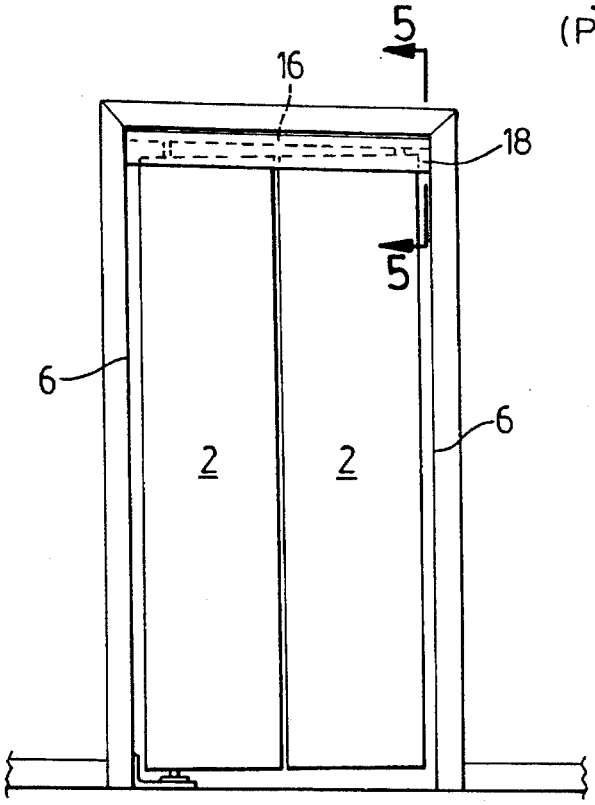
FIG. 2 is a frontal view of a bifold door installation incorporating the fascia of the invention.
Figure 9:
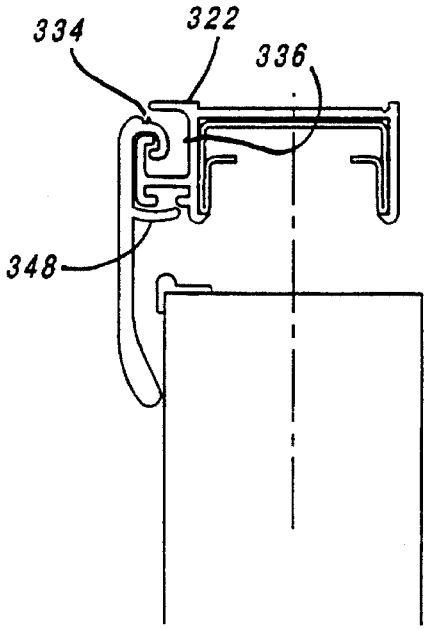

The embodiment of FIG. 9 is generally similar to that of FIGS. 2 and 5, and like reference numerals are used for like parts. The fascia element 18 is however provided with an additional arm 348 to prevent its inadvertent disengagement from the member 322.

Figure 10:
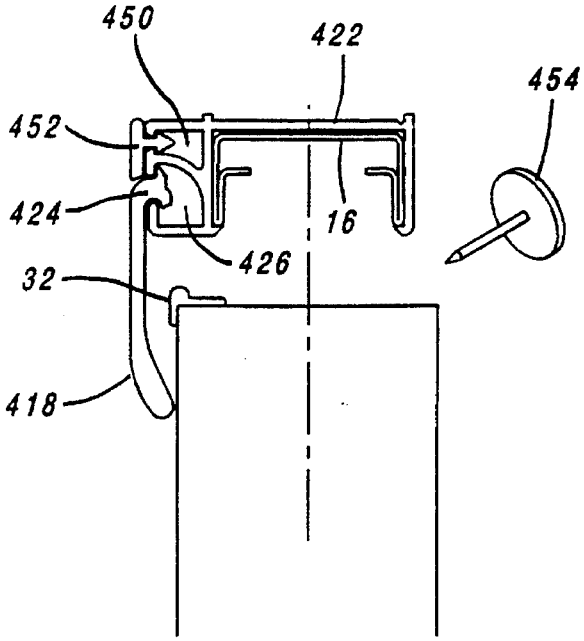

The embodiment of FIG. 10 has a support member 422 which defines two parallel longitudinal sockets 426 and 450 in its front surface. The lower socket 426 engages an arm 424 of a fascia element 418 to provide a hinge whilst the upper socket receives a spigot member of a separately formed interchangeable trim element 452. In this embodiment, flat headed nails 454 are driven into the jambs adjacent the ends of the fascia element to control its lateral movement.

The support member or members could be mounted to the head of the door independently of the track. Where multiple pairs of doors are used, the fascia element could be formed in separate sections. Some door installations will use bottom as well as top guide tracks, but this is not material to the invention. The fascia element must of course always be thinner than the minimum distance that can occur between the top of the doors and the top of the doorway, so that the doors may pass beneath it.

I claim:

1. In a bifold door installation comprising a head, a threshold and jambs, defining a doorway; a pair of bifold doors installed in the doorway for movement between a first position in which the doors lie in a common plane within the doorway and a second position in which the doors lie in parallel planes projecting in an outward direction to one side of the doorway, a first door of the pair being supported adjacent a first vertical edge thereof by top and bottom pivot members at the head and threshold of the doorway, and a second door of the pair being hingedly connected at a first vertical edge thereof to a second vertical edge of the first door; a guide track secured beneath and extending parallel to the head above the doors; and a guide member extending from the second door adjacent a top end of a second vertical edge of the second door and engaging the guide track: the improvement wherein a fascia, extending between the jambs and having top and bottom edges and outer and inner faces extending between said edges, is hingedly suspended from a support secured to the head to one side of the guide track, for pivotal movement in a direction moving said bottom edge in said outward direction about an axis parallel and displaced to said one side relative to the guide track, the fascia having a vertical extent between the top and bottom edges when so suspended that extends from said head to below top edges of the doors, and a total extent between said top and bottom edges which is less than the projection of said doors in said second position, said fascia being pivotally moveable in said outward direction to a position in which its vertical extent does not extend beneath the top edges of said doors, that portion of the inner face of the fascia which extends below the top edges of the doors when suspended presenting a smoothly profiled surface to the doors whereby the doors may move beneath the fascia between said first and second positions.

2. A bifold door installation according to claim 1, wherein said fascia and said support are longitudinal elements of constant cross-section having loosely interengaging portions providing hinged suspension of the fascia from the support.

3. A bifold door installation according to claim 2, wherein said interengaging portions are separable.

4. A bifold door installation according to claim 2, wherein said support has a portion extending between said track and the head, whereby the support is mounted to the head.

5. A bifold door installation according to claim 2, wherein a first interlocking portion provided on the fascia is projected out of a general plane of the fascia towards an interlocking portion provided on the support in a direction opposite to said outward direction, such as to cause suspension of the fascia to bias the fascia gravitationally towards the common plane of the doors in said first position.

6. A bifold door installation according to claim 1, wherein the fascia and the support have complementary detent elements interengageable upon pivotal movement of the fascia about said axis beyond said position in which its vertical extent does not extend beneath the top edges of said doors.

7. A bifold door installation according to claim 2, wherein the fascia includes a detachable trim panel forming the outer face thereof.

8. A bifold door installation according to claim 2, further including a detachable trim panel attached to said support above said fascia.

* * * * *